United States Patent [19]

Bothwell

[11] Patent Number: 4,697,554

[45] Date of Patent: Oct. 6, 1987

[54] INTERNAL COMBUSTION ENGINE AND CYLINDER HEAD THEREFOR

[76] Inventor: Peter W. Bothwell, "Meoncote" 114 Shipston Road, Stratford upon Avon, Warwickshire, West Midlands, United Kingdom

[21] Appl. No.: 833,657

[22] Filed: Feb. 21, 1986

Related U.S. Application Data

[63] Continuation of Ser. No. 569,316, Jan. 9, 1984, abandoned.

[30] Foreign Application Priority Data

Jan. 29, 1983 [GB] United Kingdom ..... 8302520

[51] Int. Cl.[4] ..... F01L 1/04

[52] U.S. Cl. ..... 123/90.22; 123/90.27; 123/193 H

[58] Field of Search ..... 123/90.22, 90.23, 90.27, 123/193 H, 432

[56] References Cited

U.S. PATENT DOCUMENTS

| | | | |
|---|---|---|---|
| 1,459,193 | 6/1923 | Bugatti | 123/90.27 |
| 1,484,376 | 2/1924 | Lanzerotti-Spina | 123/90.22 |
| 1,495,291 | 5/1924 | Fekete | 123/90.22 |
| 3,482,555 | 12/1964 | Sherbinsky | 123/90.27 |
| 4,216,778 | 8/1980 | Ichida | 123/432 |
| 4,285,310 | 8/1981 | Takizawa | 123/432 |
| 4,319,548 | 3/1982 | Fruger | 123/90.27 |
| 4,385,598 | 5/1983 | Nakatima | 123/432 |

FOREIGN PATENT DOCUMENTS

| | | | |
|---|---|---|---|
| 163789 | 5/1921 | United Kingdom | 123/90.22 |
| 289338 | 4/1928 | United Kingdom | 123/90.22 |
| 558779 | 1/1944 | United Kingdom | 123/90.22 |

*Primary Examiner*—Carl Stuart Miller

*Attorney, Agent, or Firm*—Parmellee, Miller, Welsh & Kratz

[57] ABSTRACT

A cylinder head of an internal combustion engine carries an overhead camshaft and valves which diverge in a direction from the camshaft towards a combustion chamber with which the valves are associated. Longitudinal center lines of the valve stems intersect the camshaft axis.

8 Claims, 8 Drawing Figures

INTERNAL COMBUSTION ENGINE AND CYLINDER HEAD THEREFOR

This is a continuation of co-pending application Ser. No. 569,316 filed on Jan. 9, 1984, now abandoned.

BACKGROUND TO THE INVENTION

In a reciprocating piston internal combustion engine, there is usually provided for each combustion chamber a plurality of valves, the stems of which diverge in a direction away from the combustion chamber. When these valves are operated by a single overhead camshaft, rockers are required to transmit motion from the camshaft to free ends of the valve stems. One advantage of this arrangement is that the valves can have fairly large heads. This contributes to good flow of gases into and out of the combustion chamber.

In G.B. Pat. No. 2,005,347, there is disclosed on internal combustion engine with two valves per cylinder. The valves are driven by a single overhead camshaft and the axis of the camshaft is intersected by a longitudinal centreline of each valve stem so that no rockers are required. The cylinder axes are inclined to the horizontal and the camshaft axis is offset upwardly with respect to the cylinder axes. The centre of the head of one of the valves of each cylinder lies substantially in a plane containing the axes of several cylinders of the engine. The second valve is inclined to the first valve and the centre of its head is spaced from the plane containing the axes of the cylinders. The object of this arrangement is to enable the engine as a whole to be given a large inclination relative to the vertical, with a view to obtaining a power unit of low height.

In "Repair Operation Manual" for the Austin/Morris 2200 six cylinder engine, third edition published by British Leyland Limited, there is illustrated diagrammatically in FIG. 26 a pair of valve guides for valves associated with a common cylinder, these guides converging in a direction away from the cylinder so that the valves to be mounted therein can be operated by a single overhead camshaft.

SUMMARY OF THE INVENTION

According to a first aspect of the invention, an internal combustion engine comprises a cylinder head defining valve ports which communicate with a combustion chamber defined between the cylinder head and a piston, a plurality of poppet valves, one for each of said valve ports, and an overhead camshaft for operating the valves, the respective paths of said valves, as viewed in a direction along the camshaft, converging with each other in a direction away from the combustion chamber and the valves having respective heads with centres lying on opposite sides of a plane containing the camshaft axis and a diameter of the piston.

With this arrangement, a relatively large proportion of the area of the cylinder head which is presented to the interior of the combustion chamber can be occupied by the valve heads.

An engine in accordance with the invention preferably has, for the or each piston, four valves in a cylinder head which presents to the combustion chamber a nearly flat face and which is used with a piston presenting towards the combustion chamber a cavity.

The valves can be operated through pushers or tappets by a single overhead camshaft. No rockers or followers or their supporting shafts or bearings are necessary, although followers may be used if desired.

An engine according to the invention may comprise more than one piston and define one cylinder for each piston. A cylinder head casting may be common to all cylinders of the engine or a plurality of cylinder head castings may be provided. For example, the engine may comprise two banks of cylinders with one cylinder head casting for each bank.

According to a second aspect of the invention, there is provided a cylinder head for an internal combustion engine comprising bearing means defining an axis of rotation of a camshaft and first and second valve guides for guiding respective poppet valves for movement along respective rectilinear paths, each said guide defining a longitudinal centreline of a respective path, and said centrelines, as viewed in a direction along the camshaft axis, diverging in a direction away from the camshaft axis at an angle such that a head of each valve, when fitted in a corresponding one of said guides, does not intersect the plane which contains the camshaft axis and the centreline defined by the other guide.

The cylinder head will generally be formed to present to the combustion chamber an inverse pent-roof face, that is a face comprising two portions in which respective valve ports are formed and which can be regarded as mutually inclined portions which present a reflex angle to the combustion chamber.

There are preferably provided for each combustion chamber a pair of exhaust valves and a pair of inlet valves.

One advantage realised with the invention concerns the inclination of the inlet ducts to the longitudinal axis of the cylinder. When two valves are used in a cylinder head which presents a substantially flat face to the combustion chamber, the inlet duct inclination can be favourable, as in the V12 Jaguar head. In an engine in accordance with the present invention having four valves associated with the or each cylinder and a single overhead camshaft, the inlet ducts can be similarly inclined, since space is not required to accommodate rockers. Furthermore, the inlet ducts can be substantially straight.

It is preferred that at least a part of the inlet duct, called herein the terminal part, which extends from the inlet port to a position spaced from the inlet port by a distance equal to the length of the inlet valve stem is substantially straight. In such a case, we refer herein to the centreline of the terminal part of the inlet duct as the inlet duct axis. In a case where the terminal part of the inlet duct is not substantially straight but has a curved longitudinal centreline, the term "inlet duct axis" used hereinafter means that rectilinear line whcih is parallel to the chord of the longitudinal centreline of the terminal part and has one half of its length lying on each of two opposite sides of the centerline.

In an engine in accordance with the present invention, the inlet duct axis for each cylinder is preferably arranged to approach the axis of that cylinder in a direction from the cylinder head towards the piston which moves in that cylinder. With this arrangement, air and fuel which flow through the inlet duct and inlet port enter the cylinder travelling in a direction inclined towards the centre of the cylinder, rather than towards the periphery. This assists charging of the combustion chamber.

It is preferred that the stem of the inlet valve or of one of the inlet valves associated with each cylinder should be inclined at an angle not exceeding 30°, and more preferably not exceeding 25°, to the inlet duct axis. Furthermore, it is preferred that the stem of the inlet valve should enter the inlet duct at the side thereof which is nearer to the cylinder axis.

It is also preferred that the stem of the or each exhaust valve associated with a cylinder should enter the corresponding exhaust duct at the side thereof nearer to the cylinder axis.

There is preferably provided for each valve a torsion bar spring for urging the valve towards a closed position. The torsion bar springs can be offset laterally from the valve stems and connected with the valve stems by bifurcated fingers. A finger capable of transmitting force from a torsion bar spring to a valve stem can be accommodated in a space which is insufficient to accommodate a coiled valve spring in the usual way. Thus, the use of torsion springs and fingers enables successive valve stems along the camshaft to be spaced only a small distance apart. Torsion coil springs can be used in place of torsion bar springs.

In an engine in accordance with the invention having four valves per cylinder, an angle of inclination of the inlet ducts which is more favourable than the inclination achieved in known engines with two valves per cylinder, even when the valves are vertical, can be achieved, since the centres of the inlet valves are positioned near to the perimeter of the combustion chamber and the stems of the valves associated with each cylinder are mutually convergent.

As with any other four valve head, the total inlet valve area is increased compared with a head with one inlet valve and one exhaust valve. Other merits of four valve heads are maintained, for example a small reciprocating weight for the valves and easier dissipation of heat from two exhaust valves rather than one. There can be used a single central sparking plug or a twin plug arrangement because the slight inverse pent-roof shape of the preferred head lends itself to a central squish area.

According to a further aspect of the invention, there is provided a cylinder head for an internal combustion engine and four valves mounted in the cylinder head for reciprocation along respective paths, wherein each of said four valves has a head which differs in diameter from those of the other three valves. With this arrangement, there can be provided valve ports having a large aggregate area.

In a case where there is provided for each cylinder one large inlet valve and one small inlet valve, the small inlet valve can be inclined relative to the large inlet valve and inclined at a relatively large angle to an axis of the cylinder. With this arrangement, the main charge will be admitted by the larger valve and gas entering through the port controlled by the smaller valve will promote swirling of and turbulence in the main charge in the cylinder, whilst avoiding substantial turbulence and swirling in the inlet duct leading to the larger inlet valve. It will be understood that swirling and turbulence in the inlet duct impedes flow of the charge into the combustion chamber.

A cylinder head in accordance with the further aspect of the invention is preferably used in combination with one or more pistons presenting towards the cylinder head a depression which forms a part of a combustion chamber of the kind generally called a bowl-in-piston combustion chamber. Particularly in a case where a main inlet duct defined by the cylinder head has a substantially straight terminal portion, good induction of air and fuel into the combustion chamber and good swirl of the air and fuel within the combustion chamber can be achieved.

In an engine in accordance with the invention which comprises a rectilinear row of cylinders, it is preferred that all valve springs associated with that row lie all at the same side of a plane containing the axes of the cylinders in that row. In a case where an engine comprises two, parallel rows of cylinders, this arrangement is especially advantageous and all of the valve springs associated with each row preferably lie at the side of that row remote from the other row, thereby leaving an unobstructed space between the rows for inlet ducts.

In known engines having two banks of cylinders with the axes of the cylinders in one bank parallel to one another and inclined to the axes of the cylinders of the other bank, the terminal portion of each inlet duct is generally arranged with its axis inclined at a large angle, typically in the region of 90°, to the stem of the corresponding inlet valve. With this arrangement, the mixture of fuel and air is required to flow around a corner to the inlet port, before entering a combustion chamber. Charging of the combustion chamber is impeded. The difficulty of arranging inlet ducts which do not impede charging of the cylinders is more acute with narrow V-engines, that is engines having two banks of cylinders inclined at an angle of 30° or less, and having known valve-operating gear.

The present invention is applicable with particular advantage to V-engines and, more particularly, narrow angle V-engines. The provision of a single overhead camshaft for operating the valves of each bank of cylinders, with the paths of the valves associated with each bank diverging from one another in a direction away from the camshaft, enables substantially straight inlet ducts to be provided to the cylinders of both banks. Thus, good induction can be achieved in an engine which is very compact, for the aggregate piston area provided and has a very rigid cylinder block.

In a V-engine in accordance with the present invention, the axis of one cylinder is preferably inclined at an angle not exceeding 25° to the axis of another cylinder. The engine may comprise two cylinders only.

BRIEF DESCRIPTION OF THE DRAWINGS

Examples of engines embodying the invention will now be described, with reference to the accompanying drawings, wherein.

DETAILED DESCRIPTION

Figure 1:
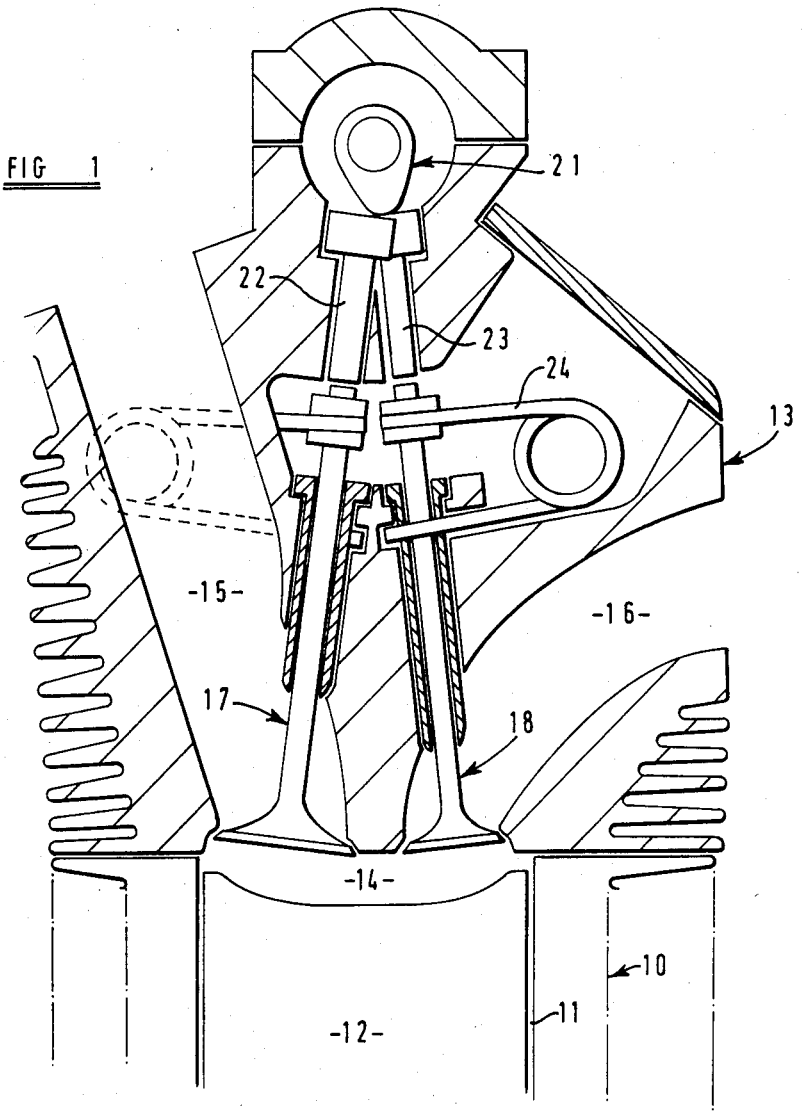
FIG. 1 illustrates diagrammatically a cross-section through an engine having four valves associated with each cylinder, the section being in a plane parallel to a longitudinal axis of a cylinder and perpendicular to the length of a camshaft of the engine.

The engines illustrated in the accompanying drawings are each reciprocating piston internal combustion engines. Each engine illustrated in FIGS. 1 to 7 may comprise a single cylinder or a plurality of cylinders, although only one cylinder and parts associated therewith are illustrated. The engine shown in FIG. 1 comprises a cylinder block 10 defining a cylinder 11 in which there is provided a piston 12. On the cylinder block there is mounted a cylinder head 13 defining four valve ports communicating with a combustion chamber 14 defined between the cylinder head and the piston. The piston presents a cavity to the combustion chamber. Alternatively, the piston could present a flat face to the combustion chamber. The cylinder head further defines a pair of inlet passages, one of which is shown in FIG. 1 at 15, leading to two of the valve ports and a pair of exhaust passages, one of which is shown at 16, leading from the other two valve ports. Inlet valves 17 and 19 control the inlet ports and exhaust valves 18 and 20 control the exhaust ports.

In the cylinder head 13, there are provided valve guides for guiding the valves along respective paths which, as viewed in FIG. 1, are mutually convergent in a direction away from the combustion chamber 14. A camshaft 21 is supported above the valves and there is interposed between each valve and the camshaft a respective tappet, two of which are indicated in FIG. 1 by the reference numerals 22 and 23.

The angle at which the valves converge is, in the illustrated example, 15°. The resulting inclination of the valve faces with respect to the cylinder head face is 7.5° for each valve. A very mild form of 'inverse pent-roof' type cylinder head combustion face results. The angle of the valve faces approximates more closely to the flat face of the head as the valve stem length and/or the valve stem plus tappet length, increases.

Figure 2:
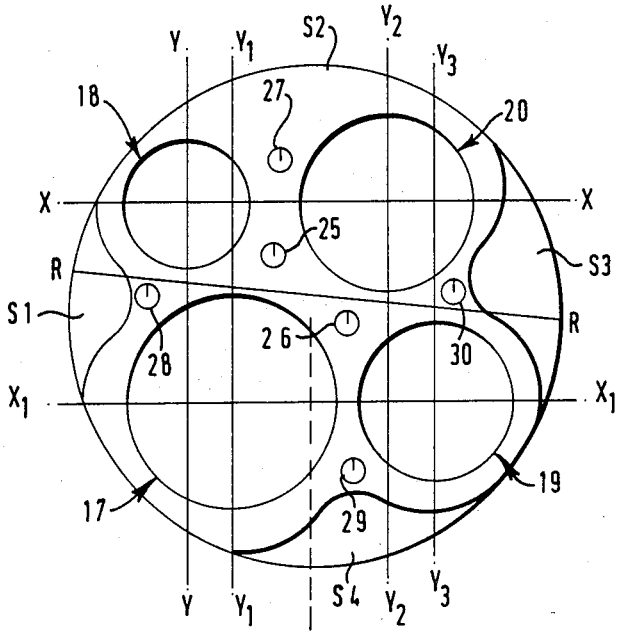
FIG. 2 illustrates a plan of the valve ports associated with one cylinder and defined by the cylinder head of the engine of FIG. 1.

In the four valve version, the diameters of the inlet valves are chosen so that one is larger than the other, while the diameters of the exhaust valve pair are also chosen so that one is larger than the other. The sizes of the inlet valves (though of different size) are preferably chosen such that their total area of heads has the normal relationship to the total area of the exhaust valve heads, viz, between 10% and 20% greater cross-sectional area for the inlet valves. A line drawn through the centres of the inlet valve faces and a line drawn through the centres of the exhaust valve faces are parallel (axes xx, $x^1X^1$) when viewed from above (FIG. 2). Lines joining the centres of each inlet and its opposite valve are offset (axes YY, $Y^1$,$Y^1$). The upper tappet faces present tangential to the base circle of the camshaft and parallel to the axis of the camshaft. The central axis of each valve stem and the associated tappet intersects the camshaft axis, preferably at right angles. The faces of the tappets adjoining the camshaft are inclined, in this example, at 7.5° to a plane which is perpendicular to the axis of the cylinder 11.

Alternatively, the heads of the two inlet valves may have the same size and the heads of the two outlet valves may have the same size, preferably a size which is smaller than that of the inlet valve heads. The provision, for one cylinder, of four valves having four respective different diameters is especially advantageous in an engine in accordance with the first aspect of the present invention but may also be used in engines which are not in accordance with the first aspect of the invention, for example an engine in which some or all of the valves are mutually convergent in a direction towards the combustion chamber.

Figure 3:
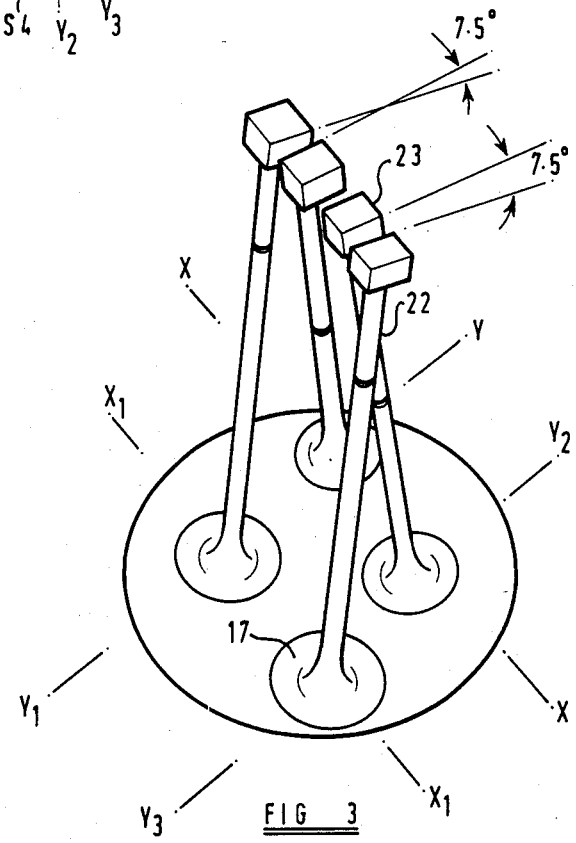
FIG. 3 illustrates diagrammatically the arrangement of the valves associated with a single cylinder of the engine of FIG. 1.

"Hairpin" valve springs 24 sited as shown (FIG. 1) are used to close the valves. The space required by conventional coil springs with bucket tappets is not available due to the close-packed array of tappet ends (FIG. 3). The hairpin springs for the exhaust valves protrude at right angles to the central axis of the head. The hairpin valve springs for the inlet valves are fitted at an angle to the central horizontal axis of the head in order to clear the induction passages which are much more vertically orientated than the exhaust passages in this example. With much "flatter" inlet passages, the inlet valve springs could be orientated in like manner to the exhaust springs. In a dimensionally larger cylinder head, it is possible to use coil springs and bucket tappets with this concept. In the three valve version illustrated in FIG. 6, the spacing of the valve stems can be such that conventional coil springs and bucket tappets can be used, but the diameter of cylinder head is relevant to such application even with a three valve head, since the bucket tappet is wider than the coil spring and has a diameter much greater than the top of the type of tappets used in the example of FIG. 1. In a case where coil springs are used, even when the cylinder bore is relatively large, it is preferable to provide tappets between the camshaft and the valve stems, in order to achieve a small angle of inclination between one valve stem and an adjacent valve stem, as viewed in a direction along the camshaft.

An additional feature which allows a choice of inlet passage angles is the fact that the camshaft and its bearings and housings are elevated upwards because the tappets length is interposed between the cam and the valve stem. This gives extra transverse space for a down draught inlet passage compared with an arrangement of camshaft which impinges lower down on a bucket tappet and coil spring.

This advantage could be equally applied to a two valve arrangement engine but an incidental advantage is gained by the use of narrow tappets rather than the much wider diameter bucket tappet. So the inward inclination of the valve stems and the use of narrow tappets results in an advantage.

The valves in the illustrated engines cannot accidentally touch each other at any time even in extremes of overlap timing because they diverge towards their heads. The cylinder head may be water or air cooled. The inlet passages to suit the valve sizes may be such that the larger passage is nearly vertical. This applies to engines in accordance with the invention with two, three and four valves per cylinder. In a case where there are, for each cylinder, a larger inlet valve and a smaller inlet valve, the smaller, highergas-speed inlet passage is inclined at a lower angle (for example 45°), so that it can induce some swirl, whereas the near-vertical inlet passage is most effective for achieving volumetric efficiency. The camshaft may be driven by any conventional means for example, chain, toothed belt, gears or shaft and bevel. The camshaft itself is such that the lobes serve in order exhaust, inlet, exhaust, inlet and is so formed that the smaller inlet valve is opened earlier than the larger inlet valve is opened.

An engine with this arrangement of valve gear is particularly suited for a motorcycle disclosed in GB Patent No. 1,448,663 with fuel tank positioned under the seat. The entry angle of the inlet passage is especially suitable for use of the ducted plenum chamber disclosed in GB Pat. No. 2,088,800. Any extra top height of such an engine is equal to the length of the tappet, for example 36–50 mm, and this is no great problem with a short stroke engine. The constructional merits of a cylinder head which presents a flat face to the combustion chamber are very nearly maintained since the valve face cut-outs are shallow (at 7.5°), although the head is not totally flat on the working face.

Figure 4:
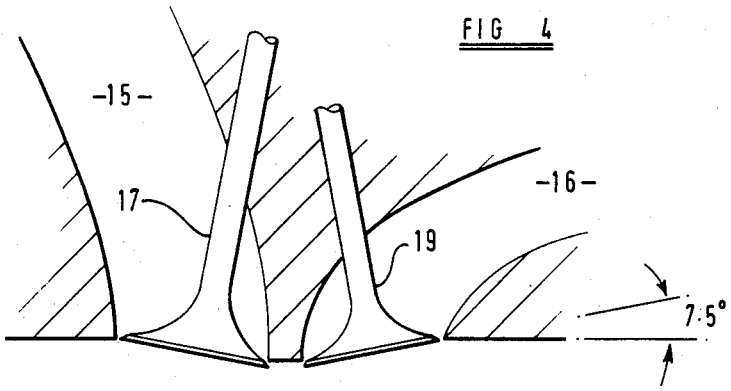
FIG. 4 illustrates diagrammatically a modification of the engine of FIG. 1.

Two alternatives are available for the mildly inverted pent-roof form of cylinder head face, namely an inverse pent-roof formed by recessed cut outs for the valve heads, which is shown in FIG. 1, and an arrangement such that the working face of the combustion chamber is elevated from the general face of the cylinder head to form a protruding inverse pent-roof. This latter arrangement is illustrated in FIG. 4. The angles of the sides of this inverse pent-roof (whether in the cut-out form or in the protruding form) are angled at 7.5° from the base flat, of the combustion face of the cylinder head. This inverse pent-roof form is not symmetrical in side and fore-and-aft views, but the division between the two sides of the pent-roof follows the division shown in the chord "RR" in FIG. 2. It will be noted that the rectilinear line RR is not parallel to the line joining the centres of the exhaust valves and does not pass through the axis of the associated cylinder. Alternatively, where larger valves are used the division between the sides of the pent-roof takes the form shown in FIG. 7 where it is no longer a straight line division but a curved line necessitated to accommodate the flats into which the larger of the inlet and exhaust valves are seated. The areas designated S1, S2, S3 and S4 on the combustion face of the cylinder head may may be used as squish areas with respect to the piston head crown. Alternate sparking plug positions are shown in FIG. 2 at 25 to 30. Further, the central area of the combustion face may in certain circumstances be used as a squish area in conjunction with appropriate contour of the piston crown, in which case the sparking plugs occupy one of the peripheral or two of the peripheral spark plug positions.

An advantage may lie in the selection of differing sizes of valve head diameter for the pair of inlet valves since the higher gas speed from the smaller diameter port may be used to assist in the generation of swirl in the combustion chamber, without promoting swirl or undue turbulence in the inlet ducts upstream of the inlet valves.

The arrangement of valves in a head may be changed from a pair of inlets on one side of the chamber and a pair of exhausts on the other, to an arrangement in which the pairs on each side consist of an exhaust valve and an inlet valve i.e. alternate exhaust and inlet valves.

As shown in FIG. 3, the four tappets associated with a single cylinder are arranged in a row along the camshaft, the tappets of the inlet valves being offset slightly to one side of the camshaft and the tappets associated with the exhaust valves being offset slightly to the opposite side of the camshaft. As viewed in the direction towards the plane containing the axes of the camshaft and the cylinder, the tappets and valve stems of the example illustrated are all parallel to each other. Offsetting of the centres of the heads of the valves of each pair permits the tappets to be positioned so that they can be operated by a series of cams on a single camshaft. This may be achieved with pairs of valves of the same diameter but it is advantageous to use valves of different diameters within each pair and, particularly advantageous to use four valves, each having a diameter different from that of each of the other three valves. The aggregate valve area achieved with this arrangement is greater than in a case where the inlet valves have the same diameter and the outlet valves have a different diameter but are the same as each other in diameter.

Figure 5:
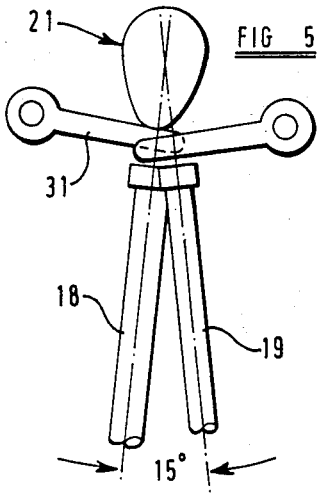
FIG. 5 illustrates a further modification of the engine of FIG. 1.

As shown in FIG. 5, there may be interposed between the camshaft and each valve, in place of a tappet, a pivoted follower 31. With this arrangement, the camshaft can be nearer to the cylinder than is the case with the arrangement shown in FIG. 1, but a wider space is required in the vicinity of the camshaft to accommodate the followers than is required to accommodate the tappets of FIG. 1. An engine having followers as shown in FIG. 5 may, in other respects, be identical with the engine illustrated in FIG. 1. Alternatively, springs of different form, for example coiled compression springs, may be substituted for the hairpin-type springs of FIG. 1. Further alternative kinds of spring which may be used are torsion bar springs, torsion coil springs, leaf springs and springs with desmodromic operation.

Figure 6:
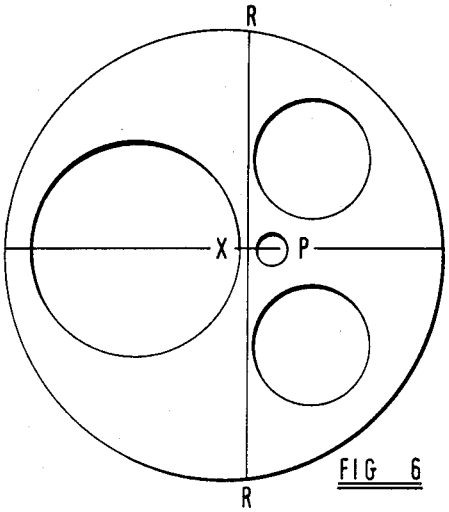
FIG. 6 illustrates an underside view of a cylinder head of an engine having three valves associated with one cylinder.

A cylinder head having three valves for a single cylinder arranged in the manner shown in FIG. 6 may be incorporated in an engine which, in other respects, is generally the same as that illustrated in FIG. 1. In the case of the cylinder head illustrated in FIG. 6, the two parts of the inverse pentroof face of the cylinder head intersect on the line RR. The inlet valve lies to one side of this line and the exhaust valves lie to the other side of the line.

The engine illustrated in FIGS. 1 and 2 may be modified by transposing the valves 17 and 19 and their associated inlet passages and by transposing the exhaust valves 18 and 20 and their associated passages.

In each engine in accordance with the invention, there is preferably a single overhead camshaft for the or each bank of cylinders.

It will be seen that, even in a case where four valves are provided for the or each cylinder, rockers are not required for transmitting motion from the camshaft to the valves. Thus, the valve gear of an engine in accordance with the invention can be relatively simple and have a low inertia. Furthermore, the engine can readily be arranged to have a high compression ratio, even in a case where the stroke of the piston is less than the piston diameter.

Figure 8:
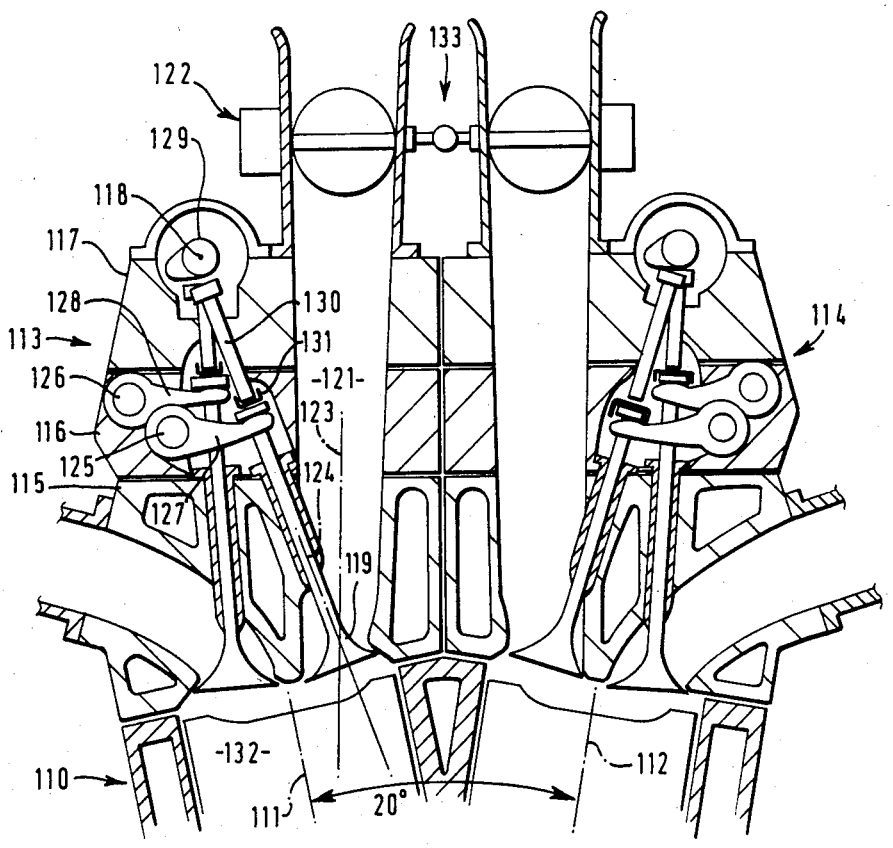
FIG. 8 is an illustration similar to FIG. 1 of an engine with cylinders in a V-configuration.

In FIG. 8, there is illustrated an engine having two cylinders or two banks of cylinders arranged in a V-configuration. Two cylinders only and parts associated with those cylinders are shown. The cylinders are defined by a common block 110 and have respective axes 111 and 112 which are mutually inclined, typically at an angle of 20°. The cylinder axes diverge in a direction towards heads 113 and 114 of the engine. In the case of a twocylinder engine, a respective head is provided for each cylinder. In a case where there are two banks of cylinders, head 113 may be common to all cylinders of one bank and head 114 common to all cylinders of the other bank.

The head 113 and parts carried thereby are substantially the same as the head 114 and parts carried thereby, an differences arising from the fact that one head is a mirror image of the other. Accordingly, only the head 113 will be described in detail. This head comprises a lower part 115, an intermediate part 116 and an upper part 117 mounted one upon the other. The lower part 115 is mounted on the block 110 and, in conjunction with valves carried by the head, closes an upper end of one of the cylinders defined by the block, in which cylinder a piston 132 reciprocates.

The lower part 115 defines four ports which communicate with the associated cylinder. Two only of these ports are shown in FIG. 8 and, for simplicity of illustration, these are represented as having respective centres in a plane which is perpendicular to a camshaft axis 118. In practice, the centres of the four ports would lie in respective different planes perpendicular to the camshaft axis. The lower part 115 carries valve guides in which are disposed poppet valves for controlling the flow of gases through the ports. Two only of these valves are shown in FIG. 8, namely an inlet valve 119 and an outlet valve 120.

The three parts of the head 113 collectively define a substantially rectilinear inlet duct 121 leading to the inlet port controlled by the valve 119. An upward continuation of the inlet duct is defined by a carburettor 122 which is preferably of the form disclosed in my copending application corresponding to United Kingdom Application No. 8235974. The head 113 and the carburettor 122 define a common, rectilinear centreline 123 of the inlet duct. It will be noted that this centreline, as viewed in a direction along the camshaft axis 118, is convergent with the cylinder axis 111 in a direction from the inlet duct towards the cylinder. This arrangement facilitates charging of the cylinder with an air/fuel mixture through an inlet port which is situated, as shown in FIG. 8, adjacent to the periphery of the cylinder.

It will be noted that, whilst the centreline 123, at the corresponding inlet port, extends in a direction which is convergent with the cylinder axis 111, when the engine is viewed along the camshaft axis 118, the longitudinal centreline 124 of the inlet valve, as viewed along the camshaft axis, diverges from the cylinder axis 111 in the direction from the inlet duct towards the cylinder. The stem of the inlet valve 119 enters the inlet duct 121 at the side thereof nearer to the cylinder axis 111 and remote from the head 114. The axis 124 of the valve stem is inclined to the longitudinal centreline 123 of the inlet duct at an acute angle which does not exceed 30° and preferably does not exceed 25°. Accordingly, the relation between the seat for the valve 119 and the centreline 123 is near to a perpendicular relation.

The intermediate part 116 of the head 113 carries springs for closing each of the valves carried by the head. The springs provided in the engine illustrated in FIG. 8 are torsion springs and these have respective torsion bars arranged with their longitudinal axes parallel to the camshaft axis 118. The torsion bars which correspond to the valves 119 and 120 respectively are identified by the reference numerals 125 and 126 in the drawing. All of the torsion bars carried by the head 113 are spaced from the corresponding valves in the same direction, that is a direction away from the head 114 and away from the inlet duct 121 and any corresponding further ducts defined by the head 113.

A finger 127 extends from the torsion bar 125, past the stem of valve 120 in close proximity thereto, to the valve 119. A similar finger 128 extends from the torsion bar 126 to the valve 120. Each finger is offset in a direction along the camshaft axis 118 from each other finger associated with the valve springs carried by the head 113. It will be noted that all of the valve springs carried by the head 113 lie at the same side of the axis 111, that is the side of the axis remote from the inlet duct 121, the axis 112 and the head 114.

The engine illustrated in FIG. 8 may be modified by substituting torsion coil springs for the torsion bar springs shown. Each torsion coil spring may be disposed, substantially entirely, within a bore formed in an associated finger which transmits force to the associated valve. With this arrangement, each finger would be supported by a pair of bearings lying outside the finger and spaced apart in a direction along the camshaft axis 118. It will be understood that the end portion of each finger which engages a corresponding valve is bifurcated.

The camshaft 129 is carried by the upper part 115 of the head and a respective tappet is interposed between each valve and the camshaft. Each tappet is co-axial with the corresponding valve stem and intersects the camshaft axis 118, preferably at right angles. Between each tappet and the corresponding valve, there is a valve cap which can be substituted by a cap of different thickness to change the valve clearance. The tapped associated with the valve 119 is identified by the reference numeral 130 and the corresponding valve cap by the reference 131. To enable a feeler guage to be inserted between a valve cap and the corresponding valve stem, a removable cover (not shown) is provided on the end of the intermediate part 116 of the head, to permit access to be gained to the interior of the head without removing the upper part 117.

The distance along the camshaft axis 118 between the axes of the stems of adjacent pairs of valves is less than the mean diameter of the heads of these valves. Because of the mutually divergent arrangement of adjacent valve stems, the corresponding tappets can be close together at the camshaft.

The valves 119 and 120 diverge from the camshaft 129 at an angle which may be in the region of 15°. Respective heads of these valves lie on opposite sides of a plane containing the camshaft axis 118 and a diameter of the piston 132 which operates in the associated cylinder. In the example illustrated, the heads of both of the valves shown are spaced slightly from this plane. Alternatively, one of the valve heads may intersect this plane. In any event, the centres of the valve heads lie on opposite sides of the plane containing the camshaft axis and a diameter of the piston.

Figure 7:
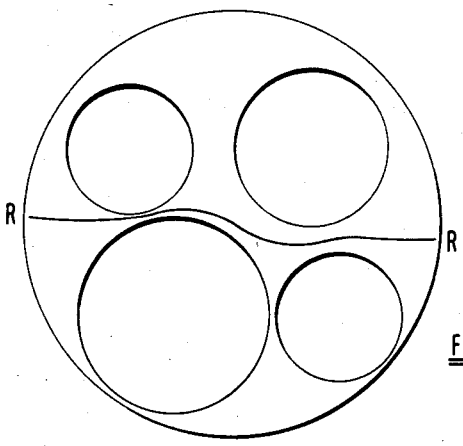
FIG. 7 is a view similar to FIG. 2 illustrating a further modification of the engine of FIG. 1.

The valves carried by the head 113 may, when viewed along the cylinder axis 111, have the arrangement shown in FIG. 7 and have the general arrangement illustrated in FIG. 3. In this arrangement, the valve stems are offset from one another along the camshaft axis, the diameter of each of the valve heads is different from the diameters of the other valve heads and each of the valve ports lies close to the periphery of the cylinder. The valve springs are spaced a substantial distance from the camshaft 129 and therefore do not prevent the four tappets associated with one cylinder being close together at the camshaft. Furthermore, since the springs are all offset to the same side of their corresponding valve stems, the springs do not restrict significantly freedom to position the inlet duct 121 so as to achieve maximum efficiency. It will be noted that each of the engines illustrated can have substantially straight inlet ducts.

It will also be noted that the piston 132 presents towards the cylinder head 113 a depression which forms a part of a bowl-in-head combustion chamber defined between the cylinder head and the piston. The combination of a substantially straight inlet duct and bowl-in-head combustion chamber promotes good charging of the combustion chamber during the induction stroke. Furthermore, if the inlet duct controlled by the smaller inlet valve is inclined at a relatively large angle to the axis 111 of the cylinder, good swirl of the charge can be achieved in the combustion chamber without swirling being impeded significantly by either the inverted pent-roof shape of the cylinder head or the piston.

As shown in FIG. 8, the inlet duct 121 and the corresponding duct defined by the head 114 are near to each other and extend in the same general direction. In fact, these ducts converge slightly in a direction away from the block 110. Accordingly, common fuel supply means 133 can be provided, this fuel supply means including a main feed pipe disposed between the two inlet ducts and branch pipes leading from that main pipe into the inlet ducts. It will be noted that the carburettor 122 can be positioned conveniently somewhat above the upper part 115 of the cylinder head but nevertheless near to the inlet port.

I claim:

1. An internal combustion reciprocating piston engine comprising a cylinder head defining at least four valve ports which communicate with a combustion chamber defined between the cylinder head and a piston, a plurality of poppet valves, one for each of said valve ports, wherein each of said valves includes a stem defining a respective axis, spring means offset laterally and protruding substantially at right angles away from the axis of each respective valve stem for closing said valves, and an overhead camshaft for operating the valves, wherein the respective paths of said valves, as viewed along an axis defined by the camshaft, converge with each other in a direction away from the combustion chamber, wherein two of the valves have respective heads with centres lying on opposite sides of a plane containing the camshaft axis and a diameter of the piston and wherein the axis of each valve stem substantially intersects the camshaft axis at a right angle and wherein at least adjacent pairs of valves positioned on the same side of said plane containing the camshaft axis also have their respective heads lying in a common plane and wherein said common plane is parallel to said camshaft axis.

2. A cylinder head for an internal combustion engine according to claim 1 comprising bearing means defining an axis of rotation of a camshaft and first, second, third and fourth valve guides for guiding respective poppet valves for movement along respective rectilinear paths towards and away from a common combustion chamber, each said guide defining a longitudinal centreline of a respective path, said centrelines each intersecting said axis of rotation substantially at a right angle and said centrelines, as viewed in a direction along the camshaft axis, diverging in a direction away from the camshaft axis at an angle such that a head of each valve, when fitted in a corresponding one of said guides, does not intersect the plane which contains the camshaft axis and the centreline defined by one of the other guides.

3. A cylinder head according to claim 2 wherein each of said four valves had a head which differs in diameter from those of the other three valves.

4. An engine according to claim 1 wherein each of said valves has a head which differs in diameter from those of the other valves.

5. An engine according to claim 4 wherein the cylinder head presents to the combustion chamber an inverse pent-roof face.

6. An engine according to claim 1 wherein said valves have respective longitudinal axes which intersect the camshaft axis substantially at right angles at respective positions spaced apart along the camshaft by distances which do not exceed the means diameter of the heads of the valves.

7. An engine according to claim 6 wherein ducts defined by the cylinder head and leading to said ports diverge in opposite directions from a reference plane which contains the camshaft axis and lies between the axes of the valves.

8. An engine according to claim 1 wherein there are four valves associated with said combustion chamber, each of said four valves has a head of a diameter different from the diameters of the heads of the other three valves, respective centres of the four valve heads are offset from one another in a direction along the camshaft and respective axes of stems of the valves are correspondingly spaced apart along the camshaft.

* * * * *